United States Patent [19]

Teed

[11] 3,931,786

[45] Jan. 13, 1976

[54] APPARATUS FOR COATING A WEB OF MATERIAL WITH A LIQUID

[75] Inventor: Richard K. Teed, Greenwood, S.C.

[73] Assignee: Riegel Textile Corporation, New York, N.Y.

[22] Filed: Feb. 13, 1974

[21] Appl. No.: 442,086

[52] U.S. Cl. ..... 118/6; 118/DIG. 3; 118/246; 118/261; 118/7

[51] Int. Cl.[2] ..... B05C 11/00

[58] Field of Search ..... 118/6, 7, 244, 261, 264, 118/DIG. 3, 15, 23, 246, 258

[56] References Cited

UNITED STATES PATENTS

| | | | |
|---|---|---|---|
| 305,892 | 9/1884 | Bruen | 118/244 |
| 455,000 | 6/1891 | Kerbaugh | 118/246 |
| 2,339,902 | 11/1943 | Thiele et al. | 118/246 |
| 2,696,192 | 12/1954 | Birchler et al. | 118/246 |
| 2,747,541 | 5/1956 | Chew | 118/DIG. 3 |
| 2,775,954 | 1/1957 | White et al. | 118/258 |
| 3,125,465 | 3/1964 | Kuts | 118/244 |
| 3,353,516 | 11/1967 | Blackburn et al. | 118/261 |
| 3,735,733 | 5/1973 | Henc | 118/261 |
| 3,811,834 | 5/1974 | Schwemmer et al. | 118/261 |

*Primary Examiner*—Mervin Stein
*Assistant Examiner*—Steven Hawkins
*Attorney, Agent, or Firm*—Parrott, Bell, Seltzer, Park & Gibson

[57] ABSTRACT

Method and apparatus for evenly coating a moving web of material with a predetermined amount of a liquid and characterized by simplicity of design, uniformity of application of the liquid and accurate control of the amount of the liquid applied, as follows. Mechanisms are provided for supplying and feeding a web of material in a longitudinal path of travel at a predetermined speed. A coating roll is positioned for transverse rotating contact with one surface of the traveling web of material and includes a covering of soft, uniformly and highly absorbent material for receiving and uniformly absorbing the coating liquid and for transferring and uniformly coating the traveling web with the liquid. An open top pan is provided for continuously receiving the coating liquid therein. The coating roll rotates within the pan for contacting and continuously absorbing all of the coating liquid within the pan above the level of the coating roll. Mechanisms are provided for continuously metering coating liquid to the pan in a predetermined amount related to the speed of travel of the web of material and the amount of liquid to be coated thereon for continuous absorption by the coating roll and continuous coating of the web with all of the predetermined amount of metered liquid.

11 Claims, 6 Drawing Figures

APPARATUS FOR COATING A WEB OF MATERIAL WITH A LIQUID

BACKGROUND OF INVENTION

This invention relates to method and apparatus for applying and evenly coating a moving web of material with a predetermined amount of a liquid and characterized by simplicity of design of the apparatus, uniformity of application of the liquid and accurate control of the amount of liquid applied.

In many manufacturing operations, it is necessary to treat a continuous web or sheet of material with a liquid for various purposes in the manufacturing operation. In this type of manufacturing operation, roll coating processes are among the most frequently used and involve the use of a kiss roll principal with a hard roll rotating in a bath of coating liquid and in contact with one surface of the web or sheet of material to be coated for applying the coating liquid to the surface of the web or sheet of material. The amount of liquid coated onto the web of material in this roll coating or kiss roll process is controlled by a doctor blade or other pick-up devices contacting the surface of the roll. These methods and apparatuses produce difficulty in controlling the amount of coating liquid applied to the web of material and obtaining a uniform coating on the web of material.

The above problems are particularly acute when the web or sheet of material being coated is of a relatively unflexible or stiff construction and the material of the web or sheet is very absorbent. With non-flexible or stiff material, the web or sheet will not evenly contact the hard kiss roll utilized in conventional roll coating processes and, therefore, a spotty or non-uniform application of the coating liquid will result. Also, with a very absorbent material, a uniform application of the coating liquid by a hard kiss roll is difficult to obtain since the coating liquid is not usually uniformly distributed along the hard kiss roll and the absorbent material will quickly absorb the coating liquid without allowing the coating liquid to be spread out or evenly distributed on the surface of the web of material.

SUMMARY OF THE INVENTION

Accordingly, it is the object of this invention to overcome the above problems and provide method and apparatus for applying and evenly coating a moving web of material, including a relatively stiff and absorbent material, with a predetermined amount of a liquid, which method and apparatus is simple in design, provides uniformity of application of the liquid and accurate control of the amount of the liquid applied and which greatly improves upon the heretofore conventional roll coating processes and apparatus utilizing the principal of a hard kiss roll rotating in a bath of coating liquid.

By this invention, it has been found that the above objects may be accomplished by providing method and apparatus, as follows.

There is provided means for supplying the web of material to be coated and means for feeding the web of material from the supply means in a longitudinal path of travel at a predetermined speed. Elongate, driven, rotating coating roll means is positioned in the path of travel in the web of material and extends generally transversely of the web for rotating contact with one surface of the traveling web. The coating roll means includes a covering of soft, uniformly and highly absorbent material disposed around the circumference thereof for receiving and uniformly absorbing the coating liquid and for transferring and uniformly coating the traveling web with the liquid. Elongate, open top pan means for continuously receiving the coating liquid therein extends transversely of the traveling web and is positioned relative to the coating roll means so that a portion of the coating roll means not in contact with the traveling web rotates within the pan through the open top thereof for contacting and continuously absorbing all of the coating liquid within the pan above the level of the roll means. And, means are provided for continuously metering coating liquid to the pan in a predetermined amount related to the speed of travel of the web of material and the amount of liquid to be coated thereon for continuous absorption by the coating roll means and continuous coating of the web with all of the predetermined amount of metered liquid.

Thus, the above objects have been accomplished in this invention by the novel and unique principal of metering continuously a predetermined amount of coating liquid to a coating roll mechanism which will continuously absorb all of the metered coating liquid evenly and uniformly and will evenly and uniformly transfer and coat the traveling web of material with all of the metered coating liquid by a soft and uniformly absorbing outer covering on the coating roll which uniformly contacts the moving web of material regardless of its stiff or unflexible characteristics and uniformly distributes the coating liquid to the web of material because the liquid is uniformly distributed on the coating roll.

Preferably, the means for feeding the web of material comprises surface-driven, take-up roll means for feeding and taking-up the web of material being coated at a constant predetermined speed.

Preferably, the coating roll means is positioned for contacting the bottom surface of the traveling web of material and includes drive means for rotating the roll in the opposite direction to the direction of travel of the web of material being coated to obtain a uniform application of the coating liquid and a uniform coating on the web of material.

Preferably, the apparatus of this invention includes tension roll means positioned in the path of travel of the web of material on each side of the coating roll means and extending generally transversely of the web for contacting the upper surface of the web and tensioning the web into engagement with the coating roll means. The tension roll means are preferably rotatably mounted and include drive means for rotating the tension roll means in the opposite direction to the direction of travel to the web of material being coated to enhance the tensioning action thereof.

Preferably, the coating roll means includes a length greater than the transverse width of the web of material being coated for coating the entire one surface of the web of material. The coating roll covering material preferably comprises a textile pile fabric which is uniformly and highly absorbent; although, this covering material may include any uniform and highly absorbent material, such as open celled foam material, etc., which is also soft and will provide an even contact with a relatively stiff web of material.

The pan means of the apparatus of this invention preferably has a generally V-shaped, transverse, cross-sectional shape and includes a partition extending across the bottom thereof to define a coating liquid receiving chamber in the bottom of the pan to which the metering means is connected. The partition includes a plurality of apertures therein spaced therealong for allowing an even flow of the metered coating liquid from the receiving chamber into the upper portion of the pan means to insure an even liquid level in the pan means for even absorption by the coating roll means along the length thereof and an even coating of the liquid on the web of material.

The coating roll means is preferably positioned in the pan means such that the rotating coating roll means and the covering thereon lightly contacts a side of the pan means during its upward rotational movement and after it has contacted and absorbed the coating liquid and immediately prior to contacting and transferring the coating liquid to the web of material for removing any excess coating liquid on the coating roll means.

The metering means preferably comprises a source of coating liquid, a conduit extending from the source of the pan means, and a variably driven meter pump disposed in the conduit for pumping coating liquid from the supply to the pan in predetermined proportion and in a predetermined amount related to the speed of travel of the web of material and the amount of liquid to be coated thereon.

BRIEF DESCRIPTION OF THE DRAWINGS

Some of the objects and advantages of this invention having been stated, other objects and advantages will appear as the description proceeds when taken in conjunction with the accompanying drawings, in which.

DESCRIPTION OF PREFERRED EMBODIMENT

Figure 1:
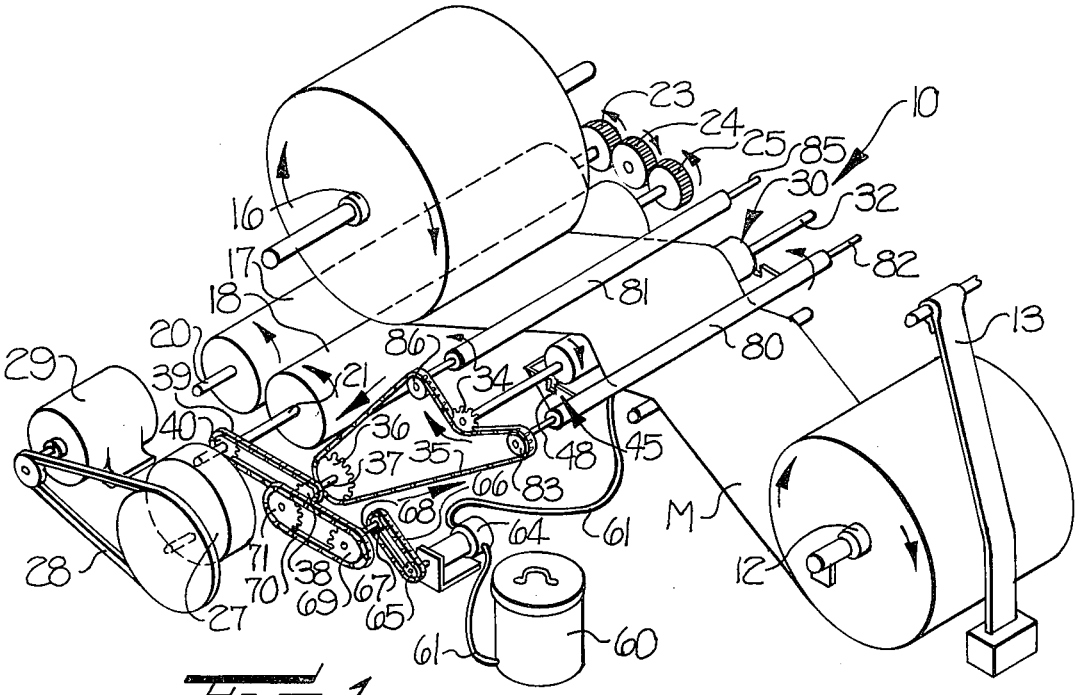
FIG. 1 is a schematic perspective view of the apparatus of this invention.

Referring now to the drawings, the apparatus for applying and evenly coating a continuous, moving web of material M with a predetermined amount of a coating liquid C is illustrated schematically in FIG. 1 and designated generally by the reference numeral 10. While the apparatus 10 of this invention is suitable for coating any material M with a liquid coating C, it is particularly adaptable for coating of a relatively stiff and absorbent material M.

The apparatus 10 includes a means for supplying a continuous web of material M. This supply means may be in the form of a conventional supply roll 12 suitably rotatably mounted (not shown) for allowing the web of material M to be pulled therefrom for the coating operation. The supply roll 12 may be suitably tensioned by a conventional strap tensioning device 13 so as to maintain a desired tension in the continuous web of material M as it is fed from the supply roll 12.

The continuous web of material M is fed from the supply roll 12 in a longitudinal path of travel at a predetermined, preferably constant, speed. In the preferred embodiment of this invention, as illustrated in the drawings, this feeding of the web of material M in the longitudinal path of travel at a predetermined speed is accomplished by a surface driven take-up roll mechanism which comprises a take-up roll 16 around which the web of material M is wound after being coated. This take-up roll 16 is suitably, conventionally mounted for vertical upward movement as the roll of material M increases in diameter on the take-up roll 16.

Figure 2:
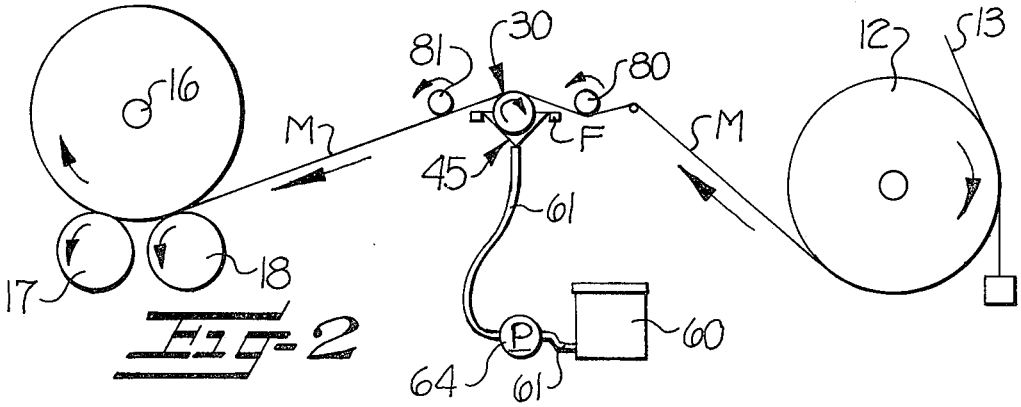
FIG. 2 is a schematic elevational view of the apparatus of this invention.
Figure 3:
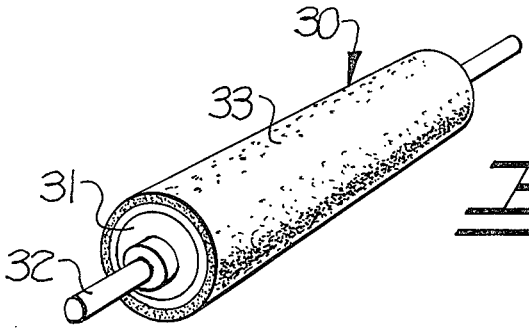
FIG. 3 is an enlarged perspective view of the coating roll utilized in the apparatus of this invention.

For rotating the roll of material M on the take-up roll 16, there is provided a pair of driven rolls 17 and 18 which are positioned parallel to each other and adjacent to each other and are driven in the direction of the arrows shown in the drawings for forming a nip on the upper surfaces threof for receiving the roll of coated material M being wound on the take-up roll 16 and for rotating this roll of material M on the take-up roll 16 in the direction of the arrows, shown in FIGS. 1 and 2, and thus taking-up the coated continuous web of material M and pulling the continuous web of material M from the supply roll 12 and feeding it in a longitudinal path of travel. The speed of travel of the continuous web of material M from the supply roll 12 through its longitudinal path of travel to the take-up roll 16 will be constant since the driven rotating rolls 17 and 18 contact the outside surface of the roll of material M as it is wound on the take-up roll 16 and thus maintains the speed of travel of the web M constant regardless of the size of the roll of material on the take-up roll 16.

The driven rotating rolls 17 and 18 are suitably rotatably mounted on the machine frame (not shown) by shafts 20 and 21, respectively. The shaft 20 includes a gear 23 on one end thereof which meshes with a gear 24 which in turn meshes with a gear 25 carried on one end of shaft 21, so that rotation of the roll 18 will drive and rotate the roll 17 through the meshing of the gears 23, 24, and 25. The shaft 21 of the roll 18 is connected with and driven by a gear reduction unit 27 which in turn is driven by a pulley and belt mechanism 28 from a motor 29. The motor 29 is any suitable variable speed motor which can be set to drive the rolls 17 and 18 at any desired, predetermined, constant speed so as to feed the continuous web of material M from the supply roll 12 to the take-up roll 16 at a predetermined constant speed.

For coating of the continuous web of material M as it passes from the supply roll 12 to the take-up roll 16 in its longitudinal path of travel at a predetermined speed, there is provided an elongate, driven, rotating coating roll 30 positioned in the path of travel of the web of material M and extending generally transversely of the web of material M for rotating contact with the bottom surface of the traveling web of material M.

The coating roll 30 comprises a generally cylindrical body portion 31 mounted on a shaft 32 extending from each end of the body portion 31 and which is suitably rotatably mounted on a frame portion (not shown) of the machine. The coating roll 30 further includes a covering 33 around the circumference of the body portion 31 of the roll 30, of soft, uniformly and highly absorbent material. This covering 33 is preferably a textile pile fabric which provides these characteristics. However, other coverings, such as open cell foam material, etc. which is both soft and highly and uniformly absorbent may be employed as the covering material.

Figure 4:
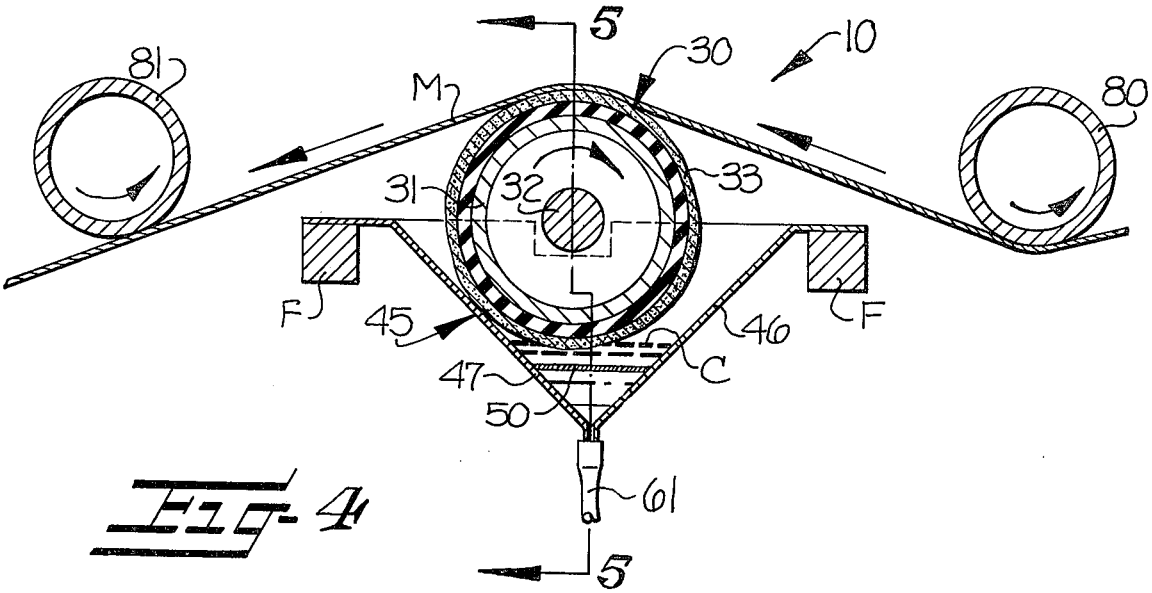
FIG. 4 is an enlarged sectional view of a portion of the apparatus of this invention.
Figure 5:
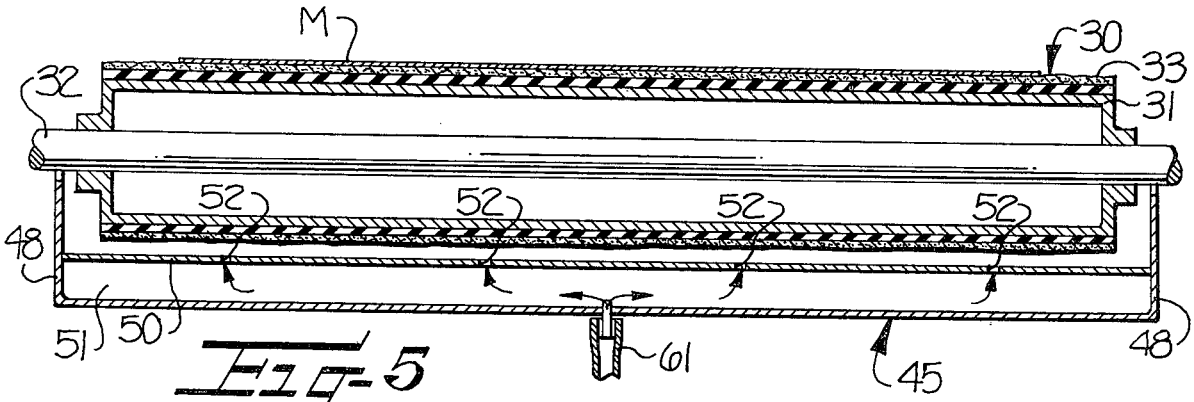
FIG. 5 is a sectional view, taken generally along the line 5—5 of FIG. 4.
Figure 6:
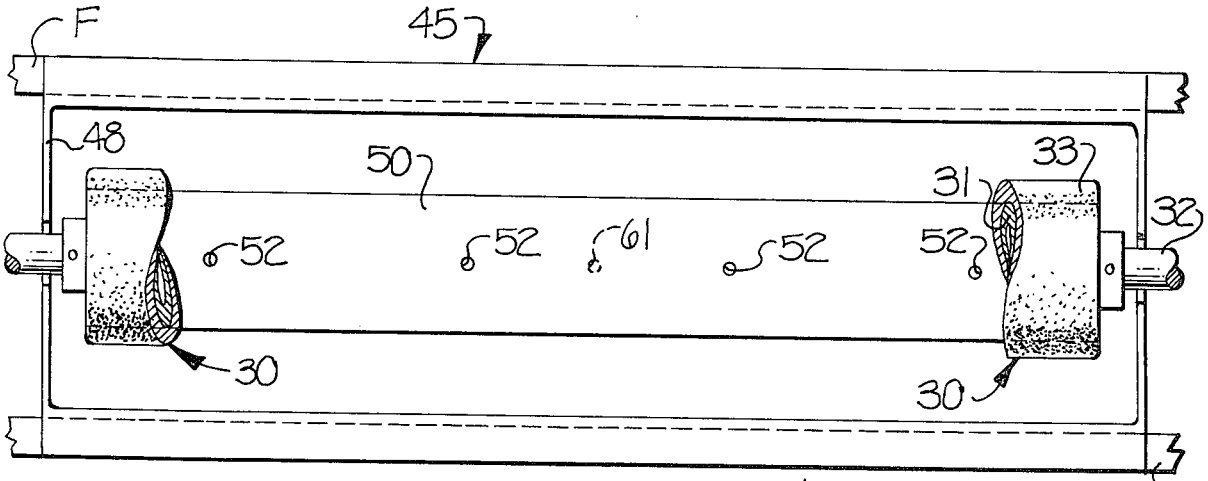
FIG. 6 is a top plan view, partly in section, of the roll coating and pan mechanism of the apparatus of this invention.

The shaft 32 of the coating roll 30 includes a sprocket gear 34 on one end thereof which is rotated by an endless chain 35 which also passes around a sprocket gear 36 carried on the end of a stub shaft 37 which includes a sprocket gear 38 on the other end thereof which is driven by an endless chain 39 which passes around a sprocket gear 40 on the shaft 21 to be driven by the shaft 21. The above arrangement of sprocket gears and chains are positioned for rotating of the coating roll 30 in the direction of the arrows shown in FIGS. 1, 2 and 4 and in a direction opposite to the direction of travel of the continuous web of material M for engaging the bottom surface of the continuous web of material M and rotating thereagainst for applying and evenly coating the liquid coating material C thereon.

Associated with the coating roller 30 is an elongate, open top, pan 45 for continuously receiving the coating liquid C therein and extending transversely of the traveling web of material M and being positioned relative to the coating roll 30 so that a portion of the coating roll 30, not in contact with the traveling web, rotates within the pan 45 through the open top thereof for contacting and continuously absorbing all of the coating liquid within the pan 45 above the level of the coating roll 30. The pan 45 comprises a generally V-shaped, transverse cross-sectional shape having longitudinal side portions 46 and 47 and end portions 48 so as to form an enclosed open top pan. The pan 45 is suitably stationarily mounted on a frame portion F (see FIG. 4) of the machine. The pan 45 further includes a partition 50 extending generally horizontally across the bottom portion of the pan 45 for defining a coating liquid receiving chamber 51 in the lower portion thereof for receiving coating liquid therein. The partition 50 includes a plurality of apertures 52 spaced therealong for allowing an even flow of the coating liquid C from the receiving chamber 51 into the main portion of the pan 45 for contact and absorption by the coating roll 30 and to insure an even liquid level in the pan 45.

For supplying the coating liquid C to the pan 45, there is provided a metering device for continuously metering the coating liquid C to the pan 45 in a predetermined amount related to the speed of travel of the web of material M and the amount of coating liquid C to be coated thereon for continuous absorption by the coating roll 30 and continuous coating of the web of material M with all of the predetermined amount of metered coating liquid C.

This metering mechanism comprises any suitable source of coating liquid C, shown in the drawings as a reservoir 60, a conduit 61 extending from the source 60 and connected with the bottom of the pan 45 for supplying coating liquid C from the source 60 to the coating liquid receiving chamber 51 in the pan 45. A variably driven meter pump 64 is disposed in the conduit 61 for pumping the coating liquid C from the supply 60 to the pan 45 in predetermined proportion and in a predetermined amount related to the speed of travel of the web of material M and the amount of coating liquid C to be coated thereon. The meter pump 64 may be of any conventional construction and is driven at a predetermined speed by a sprocket gear 65 which receives a chain 66 which also passes around a sprocket gear 67 carried on the end of stub shaft 68 which also carries a sprocket gear 69 which receives a chain 70 which passes around a sprocket gear 71 carried on the end of the shaft 37. Thus, the pump 64 is driven by the motor 29 and gear reduction unit 27 which also drives the rolls 17 and 18 and the pump 64 may be driven proportional to the speed of travel of the web of material M.

The coating roll 30 and the pan 45 preferably have a length greater than the transverse width of the web of material M being coated for coating the entire bottom surface of the traveling web of material M as it passes the coating roll 30. The coating roll 30 is positioned in the pan 45, as shown particularly in FIG. 4, such that the rotating coating roll 30 lightly contacts a longitudinal side 47 of the pan 45 during its upward rotational movement and after it has contacted and absorbed the coating liquid C, and immediately prior to contacting and transferring the coating liquid C to the web of material M for purposes of doctoring and removing any excess coating liquid C on the coating roll 30.

The apparatus 10 further includes tension rolls 80 and 81 positioned transversely across and in the path of the traveling web of material M on each side of the coating roll 30, respectively, for contacting the upper surface of the web of material M and tensioning the web into engagement with the coating roll 30. Preferably, the tensioning rolls 80 and 81 are rotatably driven in an opposite direction to the direction of travel of the web of material M being coated to enhance the tensioning action thereof. For this purpose, the coating roll 80 includes a shaft 82 having a sprocket gear 83 on the end thereof which receives and is driven by the chain 35. The roll 81 includes a shaft 85 which carries a sprocket gear 86 which also receives the chain 35 and is driven thereby.

Thus, it may be seen that the above described take-up mechanism, coating roll mechanism, tension roll mechanisms, and coating liquid metering mechanisms are all driven by chain and sprocket drives from a common gear reduction unit and variable drive motor so that the speeds of all these mechanisms may be coordinated with each other for evenly and uniformly coating the web of material with a predetermined amount of coating liquid determined by the speed of travel of the web of material and the amount of coating liquid desired to be applied thereto.

With the above described apparatus 10, it may be seen that the web of material M is fed from supply roll 12 in a longitudinal path of travel at a predetermined constant speed by the rotation of driven rolls 17 and 18 contacting the surface of the roll of coated material M on the take-up roll 16. As the web of material M is fed in such longitudinal path of travel, the bottom surface thereof comes in contact with the soft, highly and uniformly absorbent covering 33 on coating roll 30 and is held in engagement therewith by the driven counterrotating tension rolls 80, 81.

Coating liquid C is constantly fed from supply 60 through conduit 61 by a metering pump 64 so that a predetermined metered amount of coating liquid is constantly supplied to the coating liquid receiving chamber 51 of the open top pan 45 to be evenly distributed through the apertures 52 in partition 50 to form an evenly distributed coating liquid level in the pan 45. The coating roll 30 rotates partially within the pan 45 and all of the predetermined metered amount of coating liquid C being continuously fed to the pan 45, causing the liquid level to rise above the lower level of the rotating coating roll 30 therein, is absorbed by the soft, uniform and highly absorbent covering 33, on the coating roll 30. The coating roll 30 lightly engages one of the longitudinal sides 47 of the pan 45 to wipe off or doctor off any excess coating liquid C thereon and is counterrotated into engagement with the bottom surface of the traveling web of material M. Due to the soft surface of the covering 33 on the coating roll 30, the relatively stiff web of material M is evenly contacted along the length of the coating roll 30 and along the transverse width of the web of material M so that all of the predetermined metered amount of coating liquid C, continuously fed to the pan 45 and absorbed by the coating roll 30, will be transferred and evenly coated onto the bottom surface of the traveling web of material M.

A very accurate control of the amount of coating liquid C transferred to and coated on the web of material M is thus maintained since all of the predetermined amount of coating liquid C continuously metered to the pan 45 is absorbed by the uniformly and highly absorbent covering 33 on the coating roll 30 and is uniformly transferred by the soft surface of this covering 33 of the coating roll 30 to the traveling web of material M.

Thus, it may be seen, that a method and apparatus for applying and evenly coating a moving web of material with a predetermined amount of a coating liquid is provided which is simple in design, has uniformity of application of the coating liquid and accurate control of the amount of coating liquid applied.

In the drawings and specification there has been set forth a preferred embodiment of this invention and, although specific terms are employed, they are used in a generic and descriptive sense only and not for purposes of limitation.

What is claimed is:

1. Apparatus for continuously applying and evenly coating a moving web of material with a predetermined amount of a liquid and characterized by simplicity of design, uniformity of application of the liquid and accurate control of the amount of liquid applied; said apparatus comprising:

driven means for feeding the web of material in a longitudinal path of travel at a predetermined constant speed;

elongate, open top, pan means for continuously receiving the coating liquid therein and extending transversely of the traveling web;

driven means for continuously metering coating liquid to said pan means in the predetermined amount to be continuously applied to the moving web of material;

driven, elongate, rotating coating roll means positioned in the path of travel of the web of material and extending generally transversely of the web for rotating contact with one surface of the moving web at a predetermined constant speed and including a covering of soft, uniformly and highly absorbent material disposed around the circumference thereof and having a capacity for receiving and continuously uniformly absorbing the predetermined amount of coating liquid being continuously metered and for transferring and uniformly coating the traveling web with the liquid, said coating roll means being positioned partially within said pan so that a portion thereof not in contact with the web rotates within said pan through the open top thereof for contacting and continuously absorbing an amount of the coating liquid within said pan above the level of said roll means corresponding to the amount being metered into said pan by said metering means; and means operatively connected with said web feeding means, said metering means and said coating roll means for continuously driving same in predetermined relation to each other for applying and evenly coating the moving web of material with a predetermined amount of the liquid.

2. Apparatus, as set forth in claim 1, in which said means feeding the web of material comprises surface-driven, take-up roll means for feeding and taking-up the web of material being coated at a constant predetermined speed.

3. Apparatus, as set forth in claim 1, in which said coating roll means is positioned for contacting the bottom surface of the traveling web of material and said drive means rotates said roll in an opposite direction to the direction of travel of the web of material being coated to obtain a uniform application of the coating liquid and a uniform coating on the web of material.

4. Apparatus, as set forth in claim 3, in which said apparatus further includes tension roll means positioned in the path of travel of the web of material on each side of said coating roll means and extending generally transversely of the web for contacting the upper surface of the web and tensioning the web into engagement with said coating roll means.

5. Apparatus, as set forth in claim 4, in which said tension roll means are rotatably mounted and include drive means for rotating said tension roll means in an opposite direction to the direction of travel of the web of material being coated to enhance the tensioning action thereof.

6. Apparatus, as set forth in claim 1, in which said coating roll means includes a length greater than the transverse width of the web of material being coated for coating the entire one surface of the web of material.

7. Apparatus, as set forth in claim 1, in which said coating roll covering material comprises a textile pile fabric.

8. Apparatus, as set forth in claim 1, in which said pan means comprises a generally V-shaped, transverse, cross-sectional shape and includes a partition extending across the bottom thereof to define a coating liquid receiving chamber in the bottom of said pan means to which said metering means is connected, said partition including a plurality of apertures therein spaced therealong for allowing an even flow of the metered coating liquid from said receiving chamber into the upper portion of said pan means to ensure an even liquid level in said pan means for even absorption by said coating roll means along the length thereof and an even coating of the liquid on the web of material.

9. Apparatus, as set forth in claim 1, in which said coating roll means is positioned in said pan means such that said rotating coating roll means lightly contacts a side of said pan means during its upward rotational movement and after it has contacted and absorbed the coating liquid and immediately prior to contacting and transferring the coating liquid to the web of material for removing any excess coating liquid on said coating roll means.

10. Apparatus, as set forth in claim 1, in which said metering means comprises a source of coating liquid, a conduit extending from said source to said pan means, and a variable drive meter pump disposed in said conduit for pumping coating liquid from said supply to said pan in predetermined proportion and in a predetermined amount related to the speed of travel of the web of material and the amount of liquid to be coated thereon.

11. Apparatus for continuously applying and evenly coating a moving web of material with a predetermined amount of a liquid and characterized by simplicity of design, uniformity of application of the liquid and accurate control of the amount of liquid applied; said apparatus comprising:

means for supplying the web of material to be coated;

surface driven, take-up roll means for feeding the web of material from said supply means in a longitudinal path of travel at a constant predetermined speed and for taking up the coated web of material;

elongate, open top, pan means for continuously receiving the coating liquid therein and extending transversely of the traveling web, said pan means comprises a generally V-shaped, transverse, cross-sectional shape and includes a partition extending across the bottom thereof to define a coating liquid receiving chamber in the bottom of said pan means, said partition including a plurality of apertures therein spaced therealong for allowing an even flow of the coating liquid from said receiving chamber into the upper portion of said pan means to insure maintaining an even liquid level in said pan means;

metering means comprising a source of coating liquid, a conduit extending from said source to said receiving chamber in said pan means, a driven meter pump disposed in said conduit for pumping coating liquid from said supply to said pan continuously in the predetermined amount to be continuously applied to the moving web of material;

driven, elongate, rotating coating roll means positioned in the path of travel of the web of material and extending generally transversely of the web for rotating contact with the bottom surface of the traveling web in the opposite direction to the direction of travel of the web, said coating roll means including a covering of soft, uniformly and highly absorbent material disposed around the circumference thereof for receiving and uniformly absorbing the coating liquid and for transferring and uniformly coating the traveling web with the liquid, said coating roll means being partially positioned within said pan so that a portion thereof not in contact with the web rotates within said pan through the open top thereof for contacting and continuously absorbing an amount of the coating liquid within said pan above the level of said roll means corresponding to the amount being metered into said pan by said metering means;

tension means positioned in the path of travel of the web of material on each side of said coating roll means for contacting the upper surface of the web and tensioning the web of material into engagement with said coating roll means;

means operatively connected with said take-up roll means, said meter pump and said coating roll means for constantly driving same in predetermined relation to each other for applying and evenly coating the moving web of material with a predetermined amount of the liquid.

* * * * *